US007645061B2

(12) United States Patent
Stefanov et al.

(10) Patent No.: US 7,645,061 B2
(45) Date of Patent: Jan. 12, 2010

(54) HEADLIGHT ASSEMBLY

(75) Inventors: Emil Stefanov, Esslingen (DE); Veit Schwegler, Stuttgart (DE); Dagmar Wurtenberger, Stuttgart (DE)

(73) Assignee: odelo GmbH, Schwaikheim (DE)

( * ) Notice: Subject to any disclaimer, the term of this patent is extended or adjusted under 35 U.S.C. 154(b) by 505 days.

(21) Appl. No.: 11/674,990

(22) Filed: Feb. 14, 2007

(65) Prior Publication Data

US 2009/0262546 A1 Oct. 22, 2009

(30) Foreign Application Priority Data

Feb. 14, 2006 (DE) ..... 10 2006 006 634

(51) Int. Cl.
*F21V 5/00* (2006.01)

(52) U.S. Cl. ..... 362/520; 362/522; 362/521; 362/538; 362/268; 362/545

(58) Field of Classification Search ..... 362/520, 362/521, 522, 538, 545, 268, 311.02
See application file for complete search history.

(56) References Cited

U.S. PATENT DOCUMENTS 6,882,110 B2 4/2005 Ishida et al.
6,976,772 B2 * 12/2005 Albou et al. ..... 362/510
2007/0236950 A1 * 10/2007 Stefanov et al. ..... 362/496

* cited by examiner

*Primary Examiner*—Stephen F Husar
*Assistant Examiner*—James W Cranson
(74) *Attorney, Agent, or Firm*—Reising Ethington P.C.

(57) ABSTRACT

The invention relates to a low beam headlight with at least one light module. The individual light module exhibits at least one light source and at least one primary lens connected downstream of the light source; and the light source is a luminescent diode. In addition, the low beam headlight has at least one secondary lens, which is connected optically downstream of the primary lens or the primary lenses. Both the primary and the secondary lens exhibit at least two lens segments, which are arranged one over the other. In addition, at least one lens segment of the primary lens and its assigned lens segment of the secondary lens lie outside the optical axis of the light module.

The present invention develops a compact low beam headlight, whose light distribution has a clearly defined hot spot. The light intensity of the illumination decreases steadily in the direction of the basic distribution.

16 Claims, 6 Drawing Sheets

HEADLIGHT ASSEMBLY

DESCRIPTION

The invention relates to a low beam headlight with at least one light module. The individual light module exhibits at least one light source and at least one primary lens connected downstream of the light source; and the light source is a luminescent diode.

The DE 103 40 430 A1 discloses such a low beam headlight. It has three different lighting units. The desired image is controlled by means of reflectors and shutters in the individual lighting units. Owing to the optical construction, all sides of this hot spot have a high contrast boundary that bothers all drivers. The image of the basic distribution may exhibit color variations, bands, and spots.

Therefore, the present invention is based on the problem of developing a compact low beam headlight, the light distribution of which has a clearly defined hot spot. The light intensity distribution decreases steadily from the hot spot in the direction of the basic distribution.

This problem is solved with the features of the main claim. To this end, the low beam headlight has at least one secondary lens, which is connected optically downstream of the primary lens or the primary lenses. Both the primary and the secondary exhibit at least two lens segments that are placed one over the other. At least one lens segment of a primary lens is assigned to a lens segment of a secondary lens. In addition, at least one lens segment of the primary lens and its allocated lens segment of the secondary lens lie outside the optical axis of the light module. At least the light emergence surface of this lens segment of the primary lens exhibits at least one biaxially curved envelope surface. The sum of the radii of curvature of at least one surface element of the envelope surface of this light emergence surface in two planes that lie normal to each other is greater than the sum of the radii of curvature of at least one surface element of the envelope surface of at least one other light emergence surface of the primary lens in two planes that lie normal to each other.

Other details of the invention are disclosed in the dependent claims and the following description of the embodiments that are shown as schematic drawings.

Figure 1:
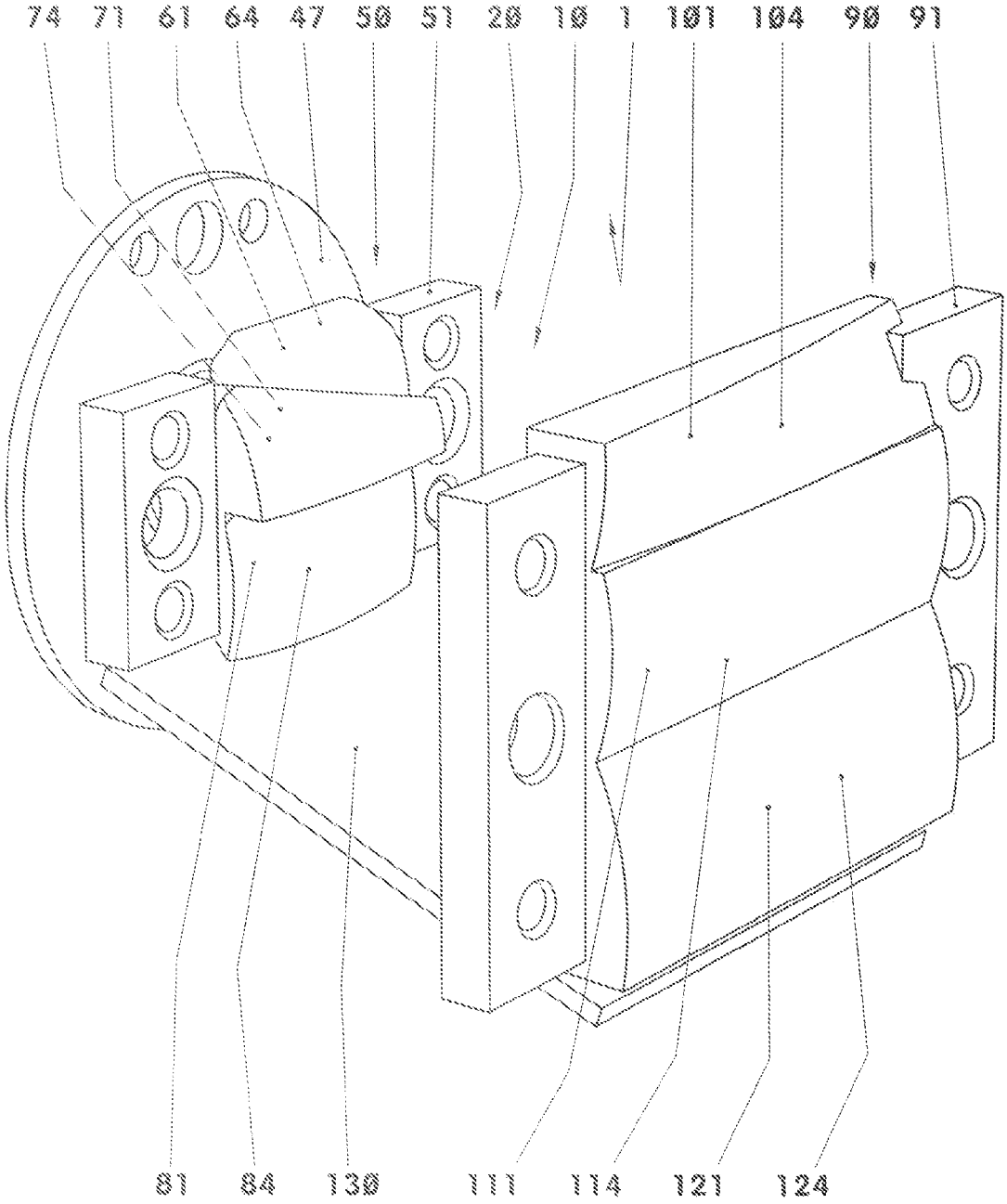
Figure 2:
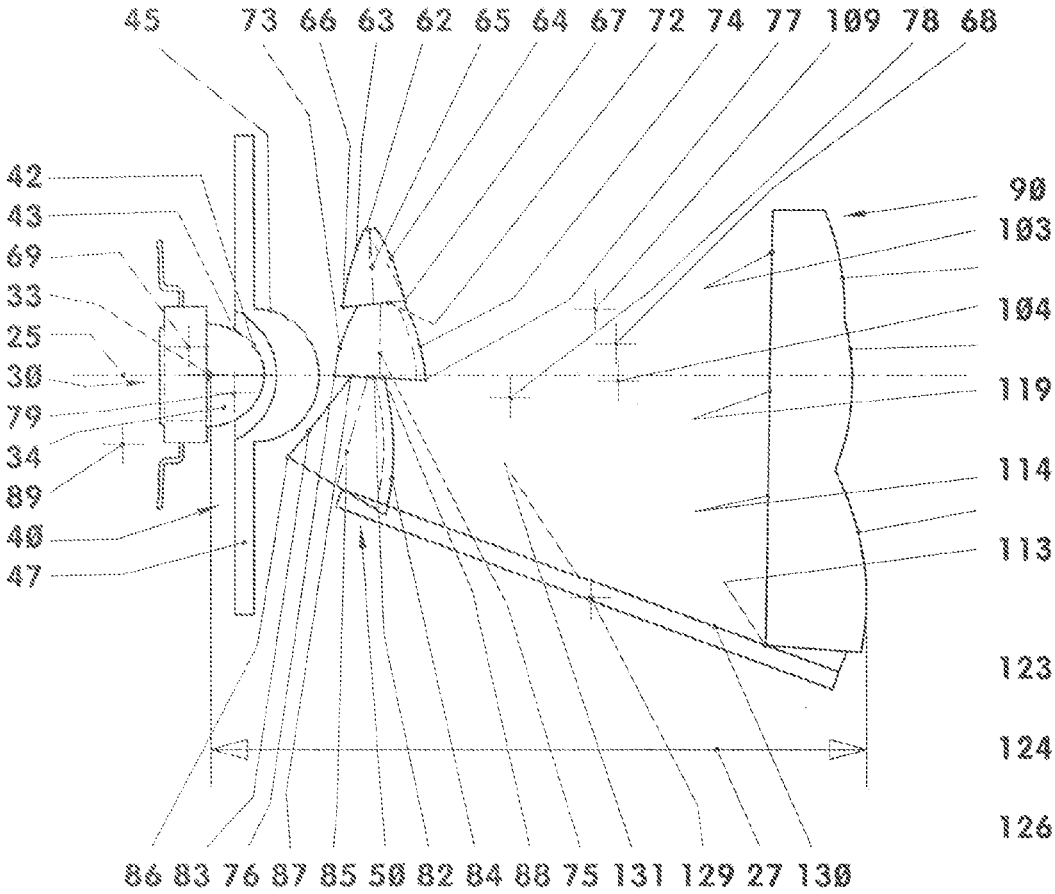
Figure 3:
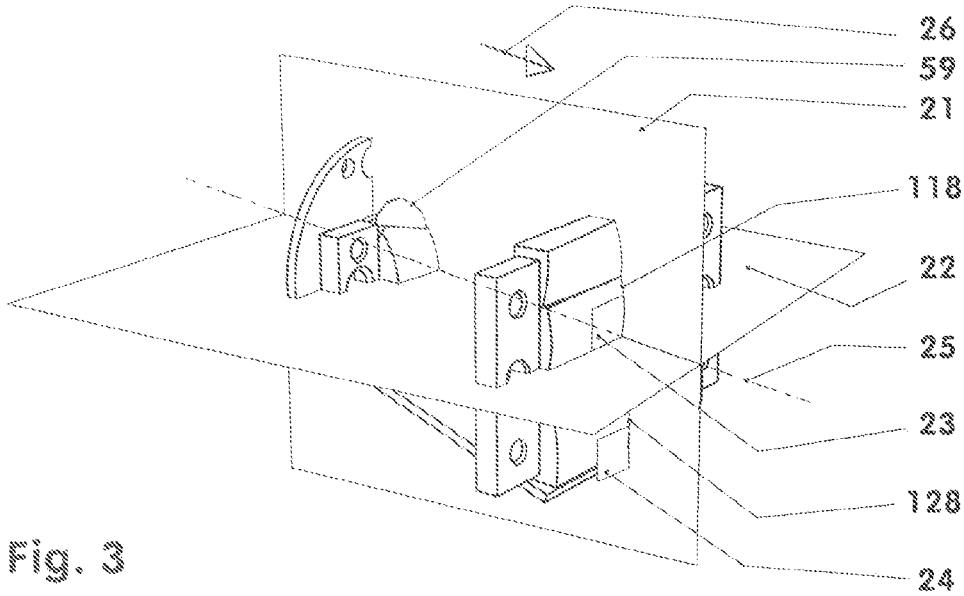
Figure 4:
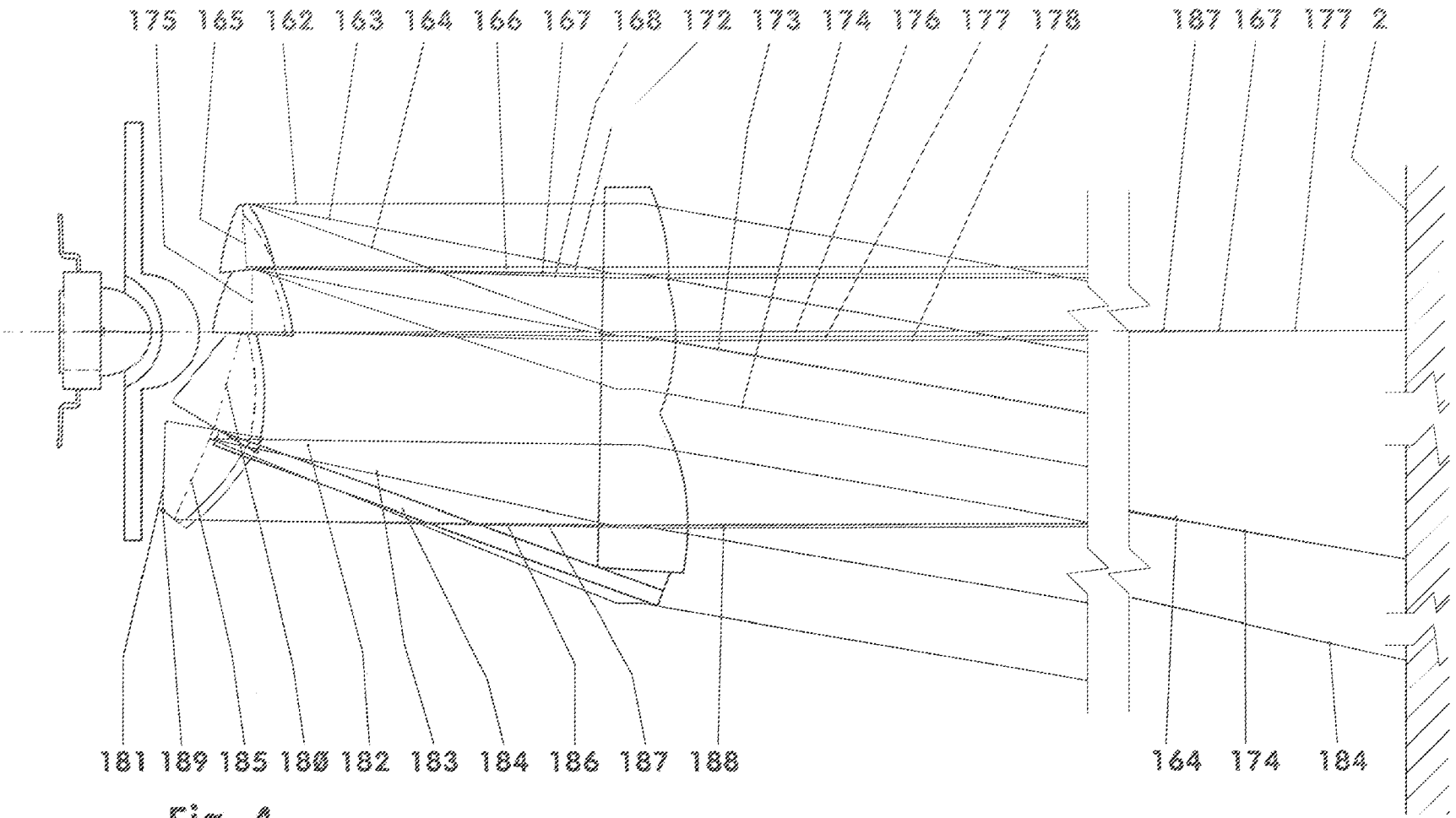
Figure 5:
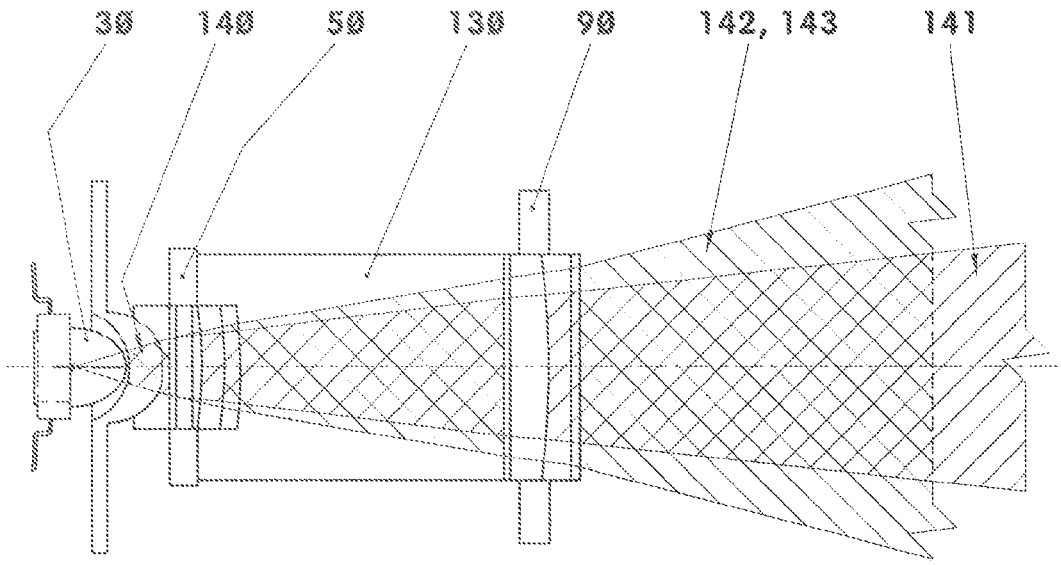
Figure 6:
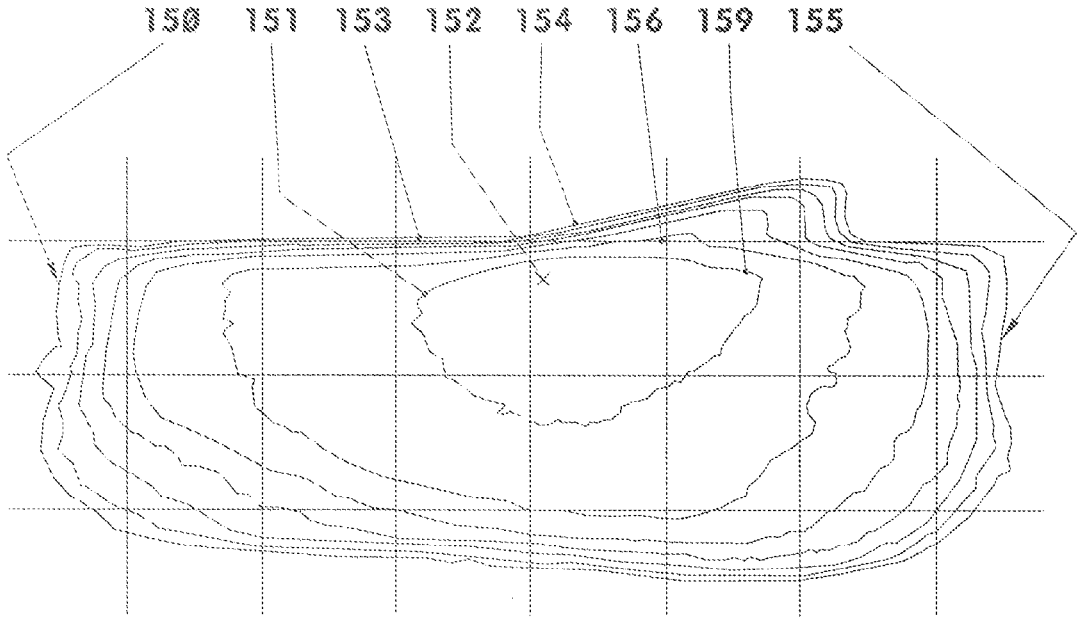
Figure 7:
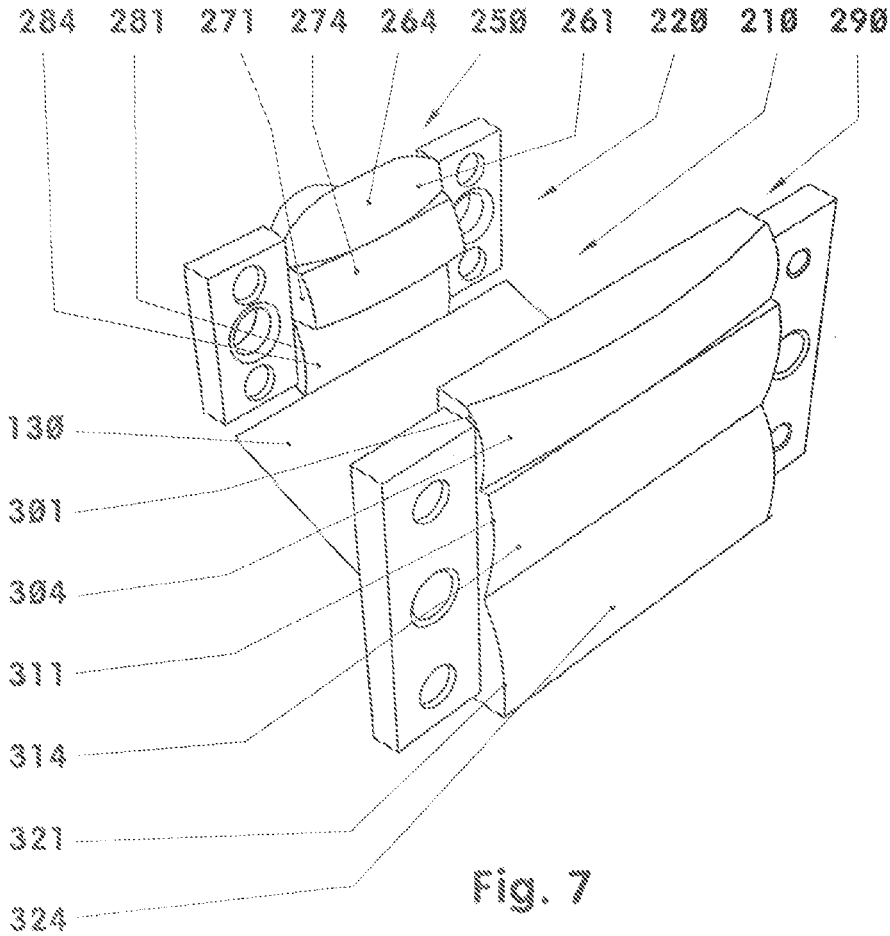
Figure 8:
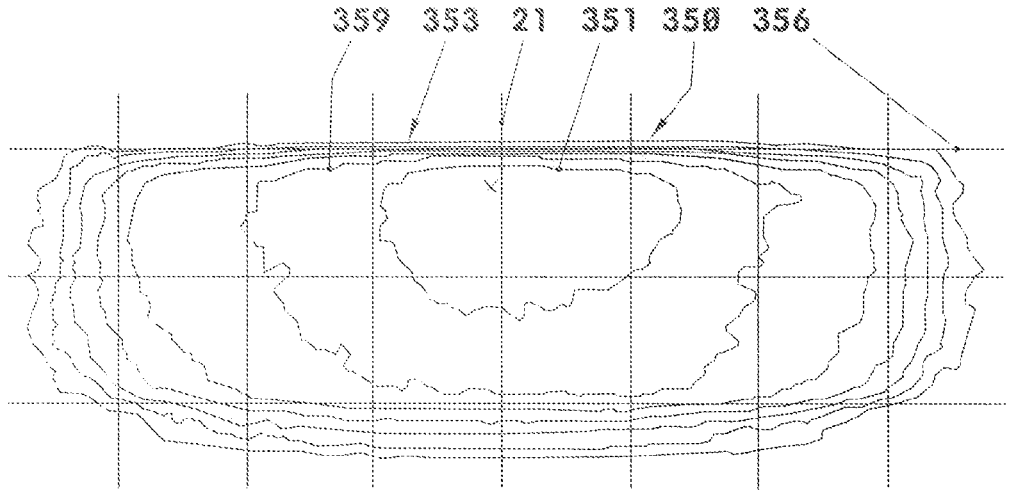
Figure 9:
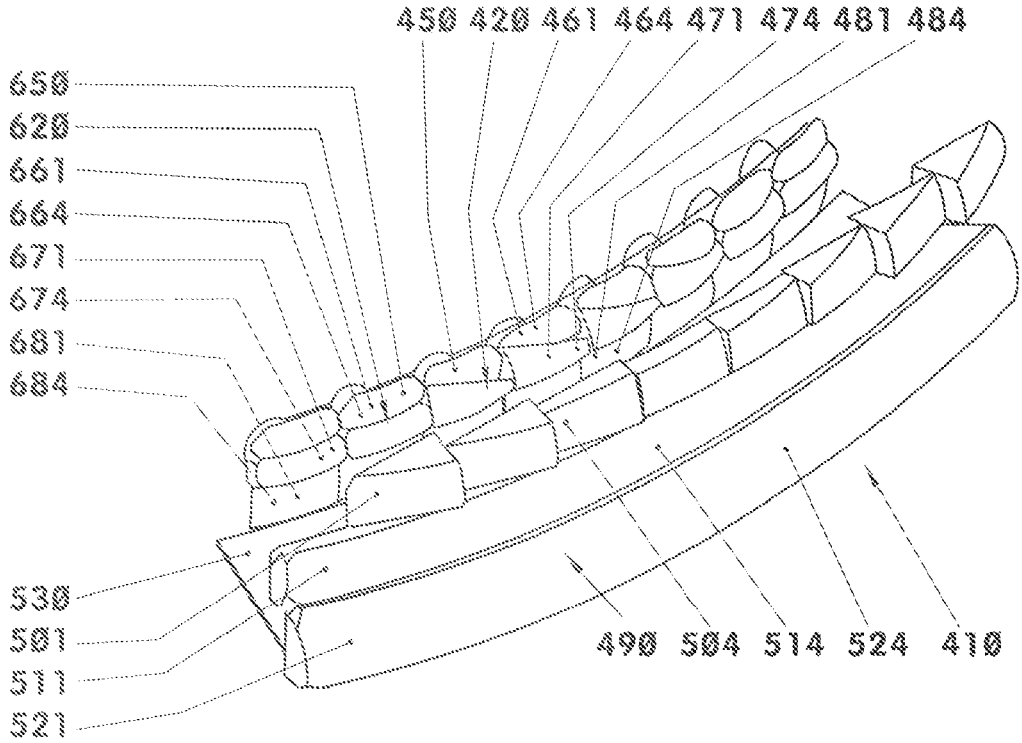
Figure 10:
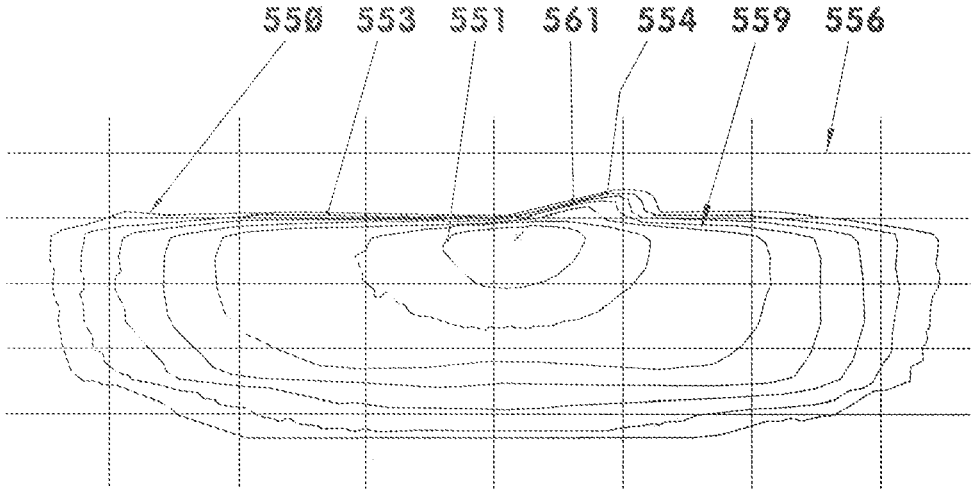

FIG. 1: low beam headlight with a light module;

FIG. 2: longitudinal sectional view of the light module of FIG. 1;

FIG. 3: middle longitudinal plane of the light module of FIG. 1;

FIG. 4: ray model of FIG. 2;

FIG. 5: top view of FIG. 1;

FIG. 6: light distribution with 15 degrees rise;

FIG. 7: low beam headlight for producing a horizontal cut-off;

FIG. 8 light distribution with horizontal cut-off;

FIG. 9: low beam headlight with a plurality of light modules;

FIG. 10: light distribution of the headlight of FIG. 9.

FIGS. 1 to 5 depict a motor vehicle low beam headlight (10) with a light module (20). Each headlight (10) may comprise one or more such light modules (20), which may then be arranged side by side and/or one over the other.

FIG. 1 is a dimetric view of the headlight (10); FIG. 2 is a longitudinal sectional view of the light module (20). The sectional plane in this drawing is the vertical middle longitudinal plane (21) of the light module (20) (see FIG. 3). FIG. 4 shows one example of the optical paths of the light module (20) from a light source (30) as far as up to a measurement wall (2). FIG. 5 is a top view of the light module (20) with an extreme simplification of the light propagation. Finally FIG. 6 shows one example of the image (150), which is produced on the measurement wall (2) when the light source (30) is in operation.

The light module (20), depicted in FIGS. 1 to 5, is, for example, 70 millimeters long, 50 millimeters wide and 50 millimeters tall. It comprises, for example, a housing (which is not illustrated here), in which the light source (30), a condenser (40), a primary (50) and a secondary lens (90) as well as a mirror (130) are disposed. In this case the light source (30), the condenser lens (40) and the primary lens (50) are connected optically in series, so that the light (140), produced by the light source (30), passes through these two lenses (40, 50). A portion of the light (140) is guided from the primary lens (50) directly to the secondary lens (90); another portion is reflected at the mirror (130) and reaches then the secondary lens (90). The light (140) passes through the secondary lens (90) into the environment (1). Therefore, the light propagation direction (26) is directed here by the light source (30) in the direction of the secondary lens (90), thus, for example, to the front in the direction of travel of the motor vehicle.

The optical axis (25) of the light module (20) is shown as the horizontal straight line in FIG. 2. It connects the light source (30) to the secondary lens (90). In addition, it is the intersecting line of the vertical middle longitudinal plane (21) with a horizontal middle longitudinal plane (22) of the light module (20) (see FIG. 3).

The light source (30) is, for example, a high power luminescent or light diode (30) that emits, for example, white light. Said light source comprises, for example, a light emitting chip (33) with a conversion layer, which is enveloped by a transparent light distributing body (34), e.g., a shaped radiating body (34). The active area of the light emitting chip (33) is, for example, one square millimeter.

In this embodiment example the shaped radiating body (34) has a height of 2.8 millimeters. It may have optical functions. For example, it may bundle the diverging light, emitted by the light emitting chip (33), in the direction of the optical axis (25) or may expand away from the optical axis (25).

In this embodiment example the light source (30) projects into a lens surface (42) of the condenser lens (40) that is curved, for example, in a concave way. In this case the boundary line (43) of the concavely curved lens surface (42) and the light emitting chip (33) span an imaginary cone-shaped shell surface, where the light-emitting chip (33) forms the apex of the cone. The acute angle of this cone is, for example, 130 degrees. The condenser lens (40) is constructed, for example, as a convex, semi-conical lens (45) on the side of the cone facing the primary lens (50). The condenser lens (40) is fastened in the housing, for example, with an annular flange (47).

The primary (50) and the secondary lens (90) are, for example, approximately orthogonal to the optical axis (25). Its minimum distance in the light propagation direction (26) is, for example, 50% of the distance between the light emitting chip (33) and the furthest light emergence surface (124) of the secondary lens (90) that faces the environment (1). This latter distance is called hereinafter the reference length (27). In this embodiment example the reference length (27) is 40 millimeters. In this case the distance from the primary lens (50) to the condenser lens (40) is, for example, 1% of this reference length (27). The distance between the primary (50) and the secondary lens (90) may also be greater than the value cited here.

In a view normal to the optical axis (25), the primary (50) and the secondary lens (90) are, for example, rectangular lenses, which exhibit lateral attachment flanges (51, 91) for fastening in the housing. Between the attachment flanges (51, 91) the lenses (50, 90) have three lens segments (61, 71, 81; 101, 111, 121) that are arranged one over the other. In the view normal to the optical axis (25), the entire surface of the lens segments (101, 111, 121) of the secondary lens in this embodiment example is 2.8 times as large as the entire surface of the lens segments (61, 71, 81) of the primary lens (50). For the lens segments (61, 71, 81) of the primary lens (50) the ratio of the height—normal to the horizontal middle longitudinal plane (22)—to the width—normal to the vertical middle longitudinal plane (21)—is the factor 1.8; for the lens segments of the secondary lens (90) it is the factor 1.5. In the embodiment example described here, the height of the primary lens (50) is 40% of the reference length (27). The primary (50) and the secondary lens (90) lie—based on their outer dimensions—at least approximately symmetrical to the vertical middle longitudinal plane (21) of the light module (20). In addition, the primary lens (50) is—based on its outer dimensions—at least approximately symmetrical to the horizontal middle longitudinal plane (22). In this embodiment example the secondary lens (90) projects with 37% of its height beyond the horizontal middle longitudinal plane (22); the rest of the secondary lens (90) lies below this plane (22).

The lens segments (61, 71 81; 101, 111, 121) are, for example, interconnected sections of plano-convex, biconvex or concave-convex lenses. They are made, for example, of an ultra transparent plastic, glass, etc. Each of the lens segments (61, 71, 81; 101, 111, 121) has a light entry surface (63, 73, 83; 103, 113, 123), facing the light source (30), and a light emergence surface (64, 74, 84; 104, 114, 124), facing away from the light source (30). All of these surfaces (63, 73, 83; 103, 113, 123; 64, 74, 84; 104, 114, 124) are pieced together, for example, of individual surface elements. These surface elements may be spherical or aspherical segments, flat surface elements, etc. Therefore, these surfaces (63, 73, 83; 103, 113, 123; 64, 74, 84; 104, 114, 124) are described below by means of their envelope surfaces. In this case an envelope surface is a geometrically interpolated, closed surface, to which the individual surface elements exhibit the slightest standard deviation. These envelope surfaces are, for example, the shell surface sections of an ellipsoid, a torus, a cylinder, etc., or may be pieced together thereof. The envelope surfaces or the envelope surface elements have, for example, a plurality of principal axes, which are arranged, for example, normal to each other. The principal axes of the envelope surfaces or the envelope surface elements may also enclose with each other an angle that is not equal to 90 degrees.

If an envelope surface or an envelope surface element is intersected in a plane, for example, in the vertical (21) or in the horizontal middle longitudinal plane (22), the resulting intersecting line is an envelope curve, which is a contour line of the respective surface (63, 73, 83; 103 113, 123; 64, 74, 84; 104, 114, 124). The radii of curvature of the contour lines may be constant along these contour lines or may increase and/or decrease continuously or discontinuously, etc. Even discontinuities or straight sections of the contour lines are conceivable.

In the above-described embodiment example the lens segments (61, 71, 81) of the primary lens (50) are parts of the top sections of lenses. The thickness of the individual lens segment (61, 71, 81) increases from the top to the bottom, as shown in FIG. 2. In this case the length of the top side (62) of the top lens segment is two percent of the reference length (27); the underside is five times the length of the top side (62). The length of the top side (72) of the middle lens segment (71) is, for example, seven percent of the reference length (27); the length of the underside is twice as long. In the bottom lens segment (81) the length of the top side (82) is, for example, five percent of the reference length (27); the length increases up to three-fold towards the bottom.

In this embodiment the height of the top (61) and the middle lens segment (71) in the middle transverse surfaces (65, 75) is 11% of the reference length (27); the height of the bottom lens segment (81) is 16% of the reference length (27). The middle transverse surface (65) of the top lens segment (61) is tilted, for example, by 3 degrees to a normal plane of the optical axis (25), whereas the top side (62) of the lens segment (61) is displaced contrary to the light propagation direction (26). The middle transverse surface (75) of the middle lens segment (71) lies, for example, normal to the optical axis (25). In this embodiment example the middle transverse surface (85) in the bottom lens segment (81) is tilted, for example, by 16 degrees to a normal plane of the optical axis (25) whereas the top side (82) is titled to the front in the light propagation direction (26).

In this embodiment example the light entry surface (63) of the top lens segment (61) is 31% of the entire light entry surfaces (63, 73, 83). The light entry surface (73) of the middle lens segment (71) is 29%; and the light entry surface (83) of the bottom lens segment (81) is 40% of the sum of these surfaces (63, 73, 83).

The top lens segment (61) is, for example, wedge-shaped. The edges of the top side (62) that are oriented transversely to the vertical middle longitudinal plane (21) lie at least approximately parallel to the horizontal middle longitudinal plane (22); in this example the bottom edges (66, 67) decrease from the right to the left side of the vehicle. In this embodiment example at least the bottom edge (66), which borders the light entry surface (63), encloses—when viewed in the light propagation direction (26)—with the horizontal middle longitudinal plane (22) an angle of 15 degrees. The top side (62) may also be constructed, for example, so as to be curved in a convex manner.

Both the light entry surface (63) and the light emergence surface (64) are curved so as to be convex. For example, the envelope surfaces of these surfaces (63, 64) are shell surface sections of a three dimensionally curved, aspherical surface. Both surfaces are constructed, for example, in such a way that two principal axes span a plane that lies parallel to the bottom edge (66) and intersects with the horizontal middle longitudinal plane (22) in a common line parallel to the optical axis (25).

Then one of the said principal axes and the third principal axis span a plane that is arranged normal to this plane and in which the optical axis (25) lies or which does not intersect the optical axis (25). The shell surface sections may also be sections of the torus shell surfaces, ellipsoid shell surfaces, etc.

In this embodiment example the bottom edge (66) of the light entry surface (63) exhibits in the vertical middle longitudinal plane (21) a distance of 10% of the reference length (27) from the horizontal middle longitudinal plane (22). From the bottom edge (67) of the light emergence surface (64) the distance to the horizontal middle longitudinal plane (22) (also measured in the vertical middle longitudinal plane (21) is 11% of the reference length (27).

In the drawing in FIG. 2, the envelope contour of the light entry surface (63) in the vertical middle longitudinal plane (21) has, for example, a constant radius of curvature. It is, for example, 41% (of the reference length (27) of the light module (20). In this embodiment the center of curvature (68) is shifted with respect to the light-emitting chip (33) by 60% of the reference length (27) in the light propagation direction (26) and is displaced above the horizontal middle longitudinal plane (22) by four percent of the reference length (27). The radius of the envelope contour of the light entry surface (63) may increase or decrease towards the top and/or towards the bottom edge. The light entry side (63) may also be constructed as a flat surface.

In the vertical middle longitudinal plane (21) the envelope surface of the light emergence surface (64) also has, for example, a constant radius of curvature. It is, for example, 61% of the reference length (27). In this embodiment the center of curvature (69) is displaced with respect to the light-emitting chip (33) by four percent of the reference length (27) in the light propagation direction (26) and is displaced above the horizontal middle longitudinal plane (22) by three percent of this length. The radius of curvature of the envelope contour of the light emergence surface (64) may increase or decrease towards the top and/or towards the bottom edge.

In this embodiment example in a plane parallel to the horizontal middle longitudinal plane (22) through the center of curvature (69), the radius of curvature of the envelope surface of the light emergence surface (64) is greater than the distance of the light source (30) to the light emergence surface (64). However, it is less than fifty times the reference length (27).

Therefore, the surface element of the envelope surface of the light emergence surface (64), which lies at the intersecting point of the two said planes—the vertical middle longitudinal plane (21) and the plane parallel to the horizontal middle longitudinal plane (22)—, is at least biaxially curved. The respective curvatures are the inverse values of the radii of curvature. The sum of the curvatures of the surface element in two planes normal to each other ranges, for example, from two to ten times the inverse value of the reference length (27). These correlations also apply analogously, for example, to a surface element of the envelope surface of the light emergence surface (64), which lies in the intersecting lines of the planes of the principal axes.

In this embodiment the middle lens segment (71), adjoining the top lens segment (61), is also wedge-shaped. The top side (72) is constructed, for example, so as to be tilted. The bottom edges (76, 77) lie, for example, parallel to the horizontal middle longitudinal plane (22).

In this embodiment example the envelope surfaces of the light entry (73) and the light emergence surface (74) are at least approximately sections of the shell surfaces of a triaxially curved body with the principal axes lying normal to each other. Two principal axes span the vertical middle longitudinal plane (21) or a plane parallel thereto. The third principal axis lies, for example, in a plane, which lies by three percent of the reference length (27) below the horizontal middle longitudinal plane (22) and is aligned parallel thereto.

The bottom edge (76) of the light entry surface (73) lies, for example, in the horizontal middle longitudinal plane (22). The bottom edge (77) of the light emergence surface (74) lies, for example, by one percent of the reference length (27) below this plane (22).

In the embodiment example shown in FIGS. 1 and 2, the radius of curvature of the osculating circle of the light entry surface (73), which intersects the plane, spanned by the horizontal principal axes, in the vertical middle longitudinal plane (21) is 26% of the reference length (27). In this example the center point (78) of this oscillating circle is displaced with respect to the light-emitting chip (33) by 44% of the reference length (27) in the light propagation direction (26) and is displaced below the horizontal middle longitudinal plane (22) by three percent of the reference length (27).

The corresponding radius of curvature of the light emergence surface (74) is, for example, 28% of the reference length (27). In this example the center of curvature (79) is displaced with respect to the light-emitting chip (33) by three percent of the reference length (27) in the light propagation direction (26) and lies below the horizontal middle longitudinal plane (22) by three percent of this length (27).

In this embodiment example in a plane parallel to the horizontal middle longitudinal plane (22) through the center of curvature (79), the radius of curvature of the light emergence surface (74) is 20% greater than the radius of curvature of the envelope surface of the light emergence surface (64) of the top lens segment (61) in a plane parallel to the horizontal middle longitudinal plane (22). The radius of curvature of the surface element of the light emergence surface (74) in this plane is it least 15% greater than the corresponding radius of curvature of the top lens segment (61). The radius of curvature of the light emergence surface (74) in a horizontal plane may also be infinite. Then the envelope surface of the light emergence surface (74) has the shape of a section of a cylinder shell surface. Therefore, the sum of the two radii of curvature is greater than the sum of the corresponding radii of curvature of the top lens segment (61).

In this embodiment example the bottom lens segment (81) of the primary lens (50) is a top section of a lens, the light entry surface (83) of which is, for example, a plane surface and the light emergence surface (84) of which is curved in a triaxially convex manner. The plane surface (83) encloses with the horizontal middle longitudinal plane (22), for example, an angle of 50 degrees. The top edge (87) of this plane surface (83) is displace with respect to the bottom edge (86) in the light propagation direction (26).

The envelope surface of the light emergence surface (84) is, for example, a surface that is curved so as to be triaxially convex. Two axes each span a plane of curvature. In this example these planes of curvature lie normal to each other. One of these planes of curvature lies, for example, in the vertical middle longitudinal plane (21); another lies, for example, in a plane that is tilted by 16 degrees with respect to the horizontal middle longitudinal plane (22). In this example, the center of curvature (89) of the osculating circle in the vertical middle longitudinal plane (21) is displaced by 13% of the reference length (27) with respect to the light-emitting chip (33) contrary to the light propagation direction (26). In this example the radius of curvature in this plane is 33% of the reference length (27). In the plane of curvature tilted in the direction of the horizontal middle longitudinal plane (22) the radius of curvature is, for example, 20% greater than the radius of curvature of the top lens segment (61) in the corresponding, for example, horizontal principal-axes plane of the envelope surface of the light emergence surface (64). Therefore, in this embodiment example the sum of the radii of curvature of a surface element of the light emergence surface (84) of the bottom lens segment (81) in two planes that lie normal to each other is greater than the sum of the corresponding radii of curvature of the light emergence surface (74) of the middle lens segment (71) and greater than the sum of the corresponding radii of curvature of the light emergence surface (64) of the top lens segment (61).

In the embodiment example all of the lens segments (101, 111, 121) in the secondary lens (90) are sections of plano-convex lenses. The light entry surfaces (103, 113, 123) of these lens segments (101, 111, 121) are, for example, plane surfaces, which lie, for example, in a common plane normal to the optical axis (25). The distance of the light entry surfaces (103, 113, 123) from the light source (30) is 82% of the reference length (27). The light entry surfaces (103, 113, 123) or the individual light entry surfaces (103; 113; 123) may also be curved, for example, so as to be concave. The optical axis (25) intersects the middle lens segment (111) of the secondary lens (90).

The top lens segment (101) and the bottom lens segment (121) of the secondary lens (90) are, for example, the top lens sections of a lens. In the top lens segment (101) the lens thickness at the top is, for example 7.5% of the reference length (27); towards the bottom the thickness of this lens segment (101) increases by about 50%. In the bottom lens segment (121) the maximum thickness is 15% of the reference length (27). The height of the top lens segment (101) is, for example, 16% of the reference length (27); the height of the bottom lens segment (121) is, for example, 27% of the reference length (27).

The middle lens segment (111) is, for example, a middle section of a lens, which in this example lies asymmetrically to the horizontal middle longitudinal plane (22). Therefore, the middle lens segment (111) comprises both a top section and a bottom section of a lens. In the direction of the top lens segment (101), it projects by 8% of the reference length (27) beyond the horizontal middle longitudinal plane (22); towards the bottom it projects beyond this plane (22) by 13% of the reference length (27). In this example the thickness of the lens segment (111) in the horizontal middle longitudinal plane (22) is 12% of the reference length (27). The middle lens segment (111) has a height of 22% of this reference length (27). The lens segments (101, 111, 121) have, for example, a constant height over their width—normal to the sectional plane of FIG. 2.

The envelope surface of the light emergence surface (104) of the top lens segment (101) has, for example, the shape of a section of an aspherical surface that is curved in a triaxially convex manner. The principal axes of the envelope surface of this surface lie, for example, normal to each other. One plane, spanned by the principal axes, lies at least parallel to a plane that is spanned by the directions of the optical axis (25) and the bottom edge (66). Another plane of curvature is tilted, for example, with respect to the vertical middle longitudinal plane (21). In the vertical middle longitudinal plane (21) in this example, the distance of the said plane of principal axes to the horizontal middle longitudinal plane (22) is 10% of the reference length (27). In the vertical middle longitudinal plane in this embodiment example the radius of curvature of the osculating circle, which intersects the said plane of the principal axes, is on average 37% of the reference length (27). The center of curvature (109) is shifted with respect the light emitting chip (33) by, for example, 57% of the reference length (27) in the light propagation direction (26) and is displaced above the horizontal middle longitudinal plane (22) by 10% of the reference length (27). Then the osculating circle in the plane of the principal axes that is titled towards the vertical middle longitudinal plane (21), is, for example, 44% of the reference length (27). The osculating circle of this lens segment (101) in the plane, which is spanned by the principal axes and which intersects the vertical middle longitudinal plane (21), has a radius of 170% of the reference length (27). In this example, therefore, the sum of these latter radii is 214% of the reference length (27).

The light emergence surface (104) may also be biaxially curved. Then it has, for example, the shape of a torus. Then the contour of the light emergence surface (104) in the vertical middle longitudinal plane (21) has a constant radius of curvature. In addition, it then holds true, for example, for each horizontal plane that the radius of curvature of the contour—the intersecting line of the light emergence surface (104) with a plane—this plane is constant.

In this embodiment example the envelope surfaces of the light emergence surfaces (114, 124) of the middle lens segment (111) and the bottom lens segment (121) are sections of cylinder shell surfaces. The cylinder axis of the light emergence surface (114) lies at least approximately in the horizontal middle longitudinal plane (22). The cylinder axis of the light emergence surface (124) lies in a plane that is at least approximately parallel thereto. Both are oriented normal to the vertical middle longitudinal plane (21). The envelope surfaces of the light emergence surfaces (114, 124) may also be elongated aspherical surfaces.

In the middle lens segment (111) in the example, the distance of the cylinder axis to the light emergence surface (114) is 34% of the reference length (27). This distance is equivalent to the radius of curvature of the contour (118) of the light emergence surface (114) in the vertical middle longitudinal plane (22). The distance of the center of curvature (119) from the light-emitting chip (33) is, for example, 60% of the reference length (27). In this example, the second plane of curvature is the horizontal middle longitudinal plane (22). Therefore, in this example the optical axis (25) lies normal to the tangential plane (23) of the light emergence surface (114) at the intersection point with the optical axis (25). The radius of curvature of the light emergence surface (114) in the horizontal middle longitudinal plane (22) is, for example, infinite. Therefore, the sum of the two radii is infinite.

In the bottom lens segment (121) the envelope contour (128) of the light emergence surface (124) in the vertical middle longitudinal plane (21) is a segment of a circle, said segment having a radius of, for example, 40% of the reference length (27). The center point (129) of this segment of a circle is shifted with respect to the light emitting chip (33) below the horizontal middle longitudinal plane (22) by 56% in the light propagation direction (26), and exhibits a distance of 33% of the reference length (27) from said horizontal middle longitudinal plane. In the bottom lens segment (121) the second radius of curvature of the light emergence surface (124) also exhibits an infinite radius. Therefore, the sum of the two radii is infinite.

In the middle (111) and the bottom lens segment (121) the light emergence surface (124) may have the shape of a torus shell surface. Then the radii of curvature of the contours of the light emergence surfaces (114, 124) in the horizontal middle longitudinal plane (22) or in planes parallel to this plane (22) are, for example, greater than fifty times the reference length (27). Then the sums of the two radii of curvature are also greater than fifty times the reference length (27).

In the illustrated embodiment example the space between the primary lens (50) and the secondary lens (40) is limited towards the bottom by means of a mirror (130). It is, for example, a flat mirror, whose edges lie here below the primary lens (50) and the below the secondary lens (90). The flat mirror (130) rests against the bottom edge (86) of the light emergence surface (84) of the bottom lens segment (81) of the primary lens (50) and against the bottom edge (126) of the light entry surface (123) of the bottom lens segment (121) of the secondary lens (90). These two edges (86, 126) define the reflecting surface (131) of the mirror (130). The mirror (130) encloses in the vertical middle longitudinal plane (21) (see FIG. 2) with the horizontal middle longitudinal plane (22) of an angle of 20 degrees. For example, the mirror (130) lies normal to the plane of the bisector of the light entry surfaces (83, 123) of the lens segment (81) of the primary lens (50) and the lens segment (121) of the secondary lens (90).

The flat mirror (130) may also be larger than shown in FIGS. 1 and 2. Thus, for example, it may be anchored laterally in the housing or in the longitudinal direction on the lenses (50, 90). In these edge regions, outside the used reflecting area (131) in the space, which is visible, for example, in a top view of the light module (20), between the lenses (50, 90), the mirror (130), which is called here a flat mirror (130), may also exhibit arches or non-reflecting areas.

The headlight (10) may also be constructed in such a manner that the flat mirror (130) rests against the lens segments (61, 101) that exhibit high curvatures. Said headlight may also border the middle lens segments (71, 111). Even the user of a plurality of mirrors (130) is conceivable. In one design, for example, the headlight (10) may be constructed with a large condenser lens (40) or with light conducting bodies without a mirror (130).

The primary (50) and the secondary lens (90) may also exhibit other lens segments. Then the shape of these lens segments corresponds largely to one of the described lens segments (61, 71, 81, 101, 111, 121) of the primary lens (50) and/or the secondary lens (90). Thus, for example, the lenses (50, 90) may have, for example, a plurality of lens segments (61, 101). At least in the light emergence surface (64) of the lens segment (61) the sum of the radii of curvature in two planes lying normal to each other is less than in at least another light emergence surface (74, 84) of the primary lens (50).

The low beam headlight (10) is constructed, for example, in such a way that at any point of an edge (76) of the light entry surface (73) of the middle lens segment (71) of the primary lens (50) there is a straight line, which connects this point to a point of the related light emergence surface (114) of the secondary lens (90). This straight line lies normal to a tangential plane (23) at the pass point of the light emergence surface (114). In addition, it lies normal to a tangential plane at the pass point of the straight line through the light entry surface (113) of the secondary lens (90). The straight line of the middle lens segments (71, 111) may lie, for example, in a plane parallel to the horizontal middle longitudinal plane (22).

When the light source (30) is in operation, the light-emitting chip (33) emits light (140), for example, as a Lambertian emitter into a hemisphere. The light diode (30) produces, for example, a luminous flux, which is greater than 50 lm. The emission is divergent and exhibits only a slightly defined maximum. The light intensity of the light source (30) decreases continuously in the direction of the edge, as the angle between the light emission and the optical axis (25) increases.

The light (140) emerging from the light source (30) is bundled, for example, by means of the condenser lens (40) in the direction of the optical axis (25). Then the light emerges from the condenser lens (40), for example, inside an imaginary cone, which expands in the light propagation direction (26) at an acute angle of 60 degrees. The axis of the cone coincides with the optical axis (25).

It is also conceivable to use a light diode (30) with a narrower emission characteristic, for example, with +/−30 degrees to the optical axis (25). In that case there is no need for the light distributing body (34) and/or the condenser lens (40). Then the light (140), emitted by the light diode (30), may, for example, be coupled into the primary lens (50) with hardly any loss.

The light (140) impinges on the light entry surfaces (63, 73, 83) of the primary lens (50) and enters through these light entry surfaces (63, 73, 83) into the lens segments (61, 71, 81) of the primary lens (50). At the same time the light bundle (140) is divided into three partial light bundles (141-143).

FIG. 4 depicts, as an example, an optical path of a single partial light bundle (141-143). FIG. 5 is a top view of the light module (20). This figure shows, for example, the top light bundle (141), the middle light bundle (142) and the bottom light bundle (143). The middle (142) and the bottom light bundle (143) are, for example, congruent to each other in the top view.

The top partial light bundle (141) is produced by light of the light source (30). Said light encloses with the optical axis (25) an angle that is, for example, greater than 20 degrees. In the embodiment example illustrated here, the light bundle (141) consists of light that is emitted by the light source (30) within an angular segment between 25 degrees and 45 degrees to the optical axis (25). Therefore, this partial light bundle (141) does not have a uniform light intensity.

This top partial light bundle (141) impinges on the light entry surface (63) of the top lens segment (61). At the same time the light of higher light intensity impinges on the bottom area of the light entry surface (63). In passing through the light entry surface (63), the individual light rays in the direction of the perpendicular on the light entry surface (63) are broken at the passage point. In passing through the light emergence surface (64) (in so doing, the light emergence surface (64) is not totally illuminated), the light bundle (141) spreads out, for example, both in the horizontal and in the vertical direction. At the same time it is oriented in such a way that the entire partial light bundle (141) impinges only on the light entry surface (103) of the top lens segment (101) of the secondary lens (90). The light bundle (141) passes through the light emergence surface (104) out of the secondary lens (90). In so doing, it is bundled somewhat in the vertical direction and in the horizontal direction. The aperture angle of the light bundle in the horizontal direction is, for example, 13 degrees; in the vertical direction, for example, 10 degrees.

For a better overview of the optical path FIG. 4 is a simplified view of a section of the middle transverse surface (65) as the object (165). In addition, for the sake of a better overview the optical paths of thin lenses are shown as the optical paths. Starting from the top and from the bottom end point of the object (165), the parallel rays (162, 166), the nodal point rays (163, 167) and the focal point rays (164, 168) proceed to the secondary lens (90). The ray model also shows the imaginary rays that lie outside the imaging area, such as the focal point ray (164). The distance from the primary lens (50) to the secondary lens (90) is greater than the maximum radius of curvature of the envelope shape of the light emergence surface (104) of the top lens segment (101) in the vertical middle longitudinal plane (21) or in a plane parallel thereto.

At a distance of, for example, 25 meters from the secondary lens (90) (this distance is greater than one hundred times the radius of curvature of the envelope surface in the vertical middle longitudinal plane (21)), the light bundle (141) produces, for example, a bright area (151), which is defined by a traverse, a so-called hot spot (151) (see FIG. 6). In the vertical direction the object (165) is perfectly imaged; in the horizontal direction a fuzzily bounded spot is produced. Therefore, the bottom edge of the object (165) is imaged as the top limit of the hot spot (151), whereas the imaging of the top edge of the object (165) defines the hot spot (151) toward the bottom. Since the partial light bundle (141) does not have a uniform light intensity, the projection of the object (165) at least in the vertical direction does not have a constant light intensity. The intensity maximum (152) of the hot spot (151) lies below the optical axis (25) and the horizontal middle longitudinal plane (22). Therefore, it lies below the horizon. The light intensity on the measurement wall (2) (when viewing only the top light bundle (141)) decays steadily from the intensity maximum (152) of the hot spot (151) towards the outside. In this example the illuminated area (150) increases towards the top right, so that the angle of climb corresponds to the tilt angle of the bottom edge (66) to the horizontal middle longitudinal plane (22).

The height of the illuminated area (150) is derived from the quotient comprising the height of the object and the distance of the lens segments (61) and (101), multiplied by the distance between the headlight (10) and the measurement wall (2).

The middle partial light bundle (142) is produced by light of the light source (30). Said light encloses with the optical axis (25) an angle that is, for example, less than 25 degrees. Therefore, this partial light bundle (142), too, does not have a uniform light intensity.

The middle partial light bundle (142) passes through the light entry surface (73) into the middle lens segment (71) of the primary lens (50). Upon leaving the primary lens (50)—even in this lens segment (71) only a portion of the light emergence surface (74) is illuminated—the light bundle (142) is expanded, for example, in the horizontal direction (see FIG. 5). In the vertical direction the light bundle (142) is directed by means of the lens segment (71) of the primary lens (50) in such a manner that the entire light bundle (142) impinges on the light entry surface (113) of the middle lens segment (111) of the secondary lens (90).

Upon leaving the secondary lens (90), the light bundle (142) is bundled, for example, in the vertical direction into an angular segment of 10 degrees. In the horizontal direction the light bundle (142) is expanded, for example, to an angular segment of 26 degrees. Then the object (175) (simplified here as a part of the middle traverse surface (75)) is projected in the vertical direction at a distance, which is equivalent, for example, to one hundred times the reference length (27), and perfectly imaged. In the horizontal direction the result is a wide illuminated field.

FIG. 4 shows an extremely simplified optical path of this partial light bundle (142). The bottom edge of the object (175) is produced by the bottom edge (76) of the light entry surface (73). This edge of the object (175) is a bright-dark limit inside the lens segment (71). In the portion of the partial light bundle (142), which images the bottom end of the object (175), the parallel ray (176), the nodal point ray (177) and the focal point ray (178) coincide at least approximately. Thus, these rays (176-178) lie in a common plane that is normal to the tangential plane (23) on the light emergence surface (114). Upon leaving the secondary lens (90), the rays (176-178) lie at least approximately parallel to each other. In the embodiment example illustrated here, they lie in the horizontal middle longitudinal plane (22). The object edge or rather the bottom edge (76) of the light entry surface (73) is imaged as a sharply defined top edge (153), the so-called cut-off (153), of the illuminated area (150) on the measurement wall (2).

When the light module (20) is operated solely with this light bundle (142)—the light entry surfaces (63, 83) of the two other lens segments (61, 81) are, for example, dimmed—the measurement wall (2), set up, for example, at a distance of 25 meters, shows an illuminated field having the shape of the object (175) of the lens segment (71). This field has only slight brightness variations. The portion of the light bundle (142) that is emitted by the light source (30) at least approximately parallel to the optical axis (25)—that is, for example, inside an angle of 5 degrees to the optical axis (25)—projects the bottom edge of the object (175) as a horizontal, sharply defined cut-off (153), thus as the bright-dark boundary on the measurement wall (2) (see FIG. 6). The image of the other boundaries (155) of the illuminated area (150) is blurred. In this example the cut-off (153) lies, for example, on the horizon plane (156), which coincides with the horizontal middle longitudinal plane (22). The cut-off may also lie, for example—depending on the installation in the motor vehicle—0.7 degrees below the horizon line (156).

In the light module (20), depicted in FIGS. 1 and 2, the quotient comprising the height of the object (165) of the lens segment (61) of the primary lens (50) and the distance of the lens segment (101) to the lens segment (61) is at least approximately equal to the corresponding quotient of the lens segments (71) and (111). Therefore, on a measurement wall at a distance of, for example, 25 meters, the height of the two images is at least approximately equal.

The bottom light bundle (143) passes, for example, through the light entry surface (83) into the bottom lens segment (81) of the primary lens (50). The light bundle (143), issuing from this lens segment (81), impinges on the flat mirror (130). In so doing, the portion of the light bundle (143) that emerges near the top edge (88) of the light emergence surface (84) is guided to that area of the mirror (130) that lies close to the secondary lens (90). The portion of the light bundle (143) that emerges from the primary lens (50) near the bottom edge (86) of the light emergence surface (84) impinges on the area of the mirror (130) close to the primary lens (50). The light bundle (143) is reflected on the flat mirror (130) in the direction of the secondary lens (90). Here the light bundle (143) impinges on the bottom lens segment (121) and passes through the light entry surface (123) into the secondary lens (90). The portion of the light bundle (143), which is reflected near the primary lens (50), enters almost horizontally into the upper area of the light entry surface (123). The portion of the light bundle (143), which is reflected near the secondary lens (90), enters almost horizontally into the bottom area of the light entry surface (123).

Upon issuing from the secondary lens (90), the light bundle (143) has, for example, an aperture angle of 10 degrees in the vertical direction. In the horizontal direction the light bundle (143) expands, for example, to an angular segment of 26 degrees.

The ray model in FIG. 4 shows the lens segment (81) as a virtual image (181), which is mirrored on the mirror (130). A part (180) of the middle transverse surface (85) passes over into the virtual object (185). The top edge, which belongs to the light bundle (143) and is imaged, for example, on the measurement wall (2),—depicted, for example by means of the nodal point ray (187)—is at least approximately congruent with the nodal point ray (177) of the light bundle (142). Therefore, the cut-off lines (153) of both partial light bundles (142, 143) largely coincide. The maximum deviation of two nodal point rays (177, 187), spanning a vertical plane, is, for example, 1 degree. Then the top edge of the light bundle (143) lies, for example, below the top edge of the light bundle (142). In a lens segment (111, 121), where the center of the lens is not imaged, the nodal point ray (177, 187) is an imaginary nodal point ray (177, 187).

Even in the optical path of the light bundle (143) the focal point ray (186) and the middle ray (187), both of which start from the bottom edge of the virtual object (185), coincide at least approximately. In the vertical direction the light bundle (143) in this embodiment has expanded more than the light bundle (142). In this example the light distribution, produced on the measurement wall, is 30% higher than the image, which is produced by means of the middle lens segments (71, 111). The quotient comprising the height of the object (185) and the distance of the lens segments (81, 121) is also greater by this amount than the corresponding quotient of the lens segments (71, 111) for the middle light bundle (142). The two quotients may also be the same amount, thus the height of the illuminated areas being the same.

In the embodiment example a straight line connects one point each of the edge (87), the virtual image (189) of which produces the boundary of the object (185), and a point of the related light emergence surface (124) of the secondary lens (90). The straight line is normal to a tangential plane (24) at the point of the light emergence surface (124). In addition, it is normal to a tangential plane at the pass point of the straight line through the light entry surface (123) of the secondary lens (90).

One of these straight lines and a similar straight line of the middle lens segments (71, 111) span a common vertical plane. These two straight lines enclose in this plane an angle that is less than 1 degree. For example, this angle is 0.7 degrees, whereas, for example, the straight line of the bottom lens segments (81, 121) in the light propagation direction (26) is tilted more towards the bottom.

When the light module (20) is operated solely with this light bundle (143)—the light entry surfaces (63, 73) of the two other lens segments (61, 71) are, for example, dimmed—the measurement wall, set up, for example, at a distance of 25 meters, shows an illuminated area with only slight brightness variations.

Overlapping the two basic distributions, which are generated in this embodiment example by the middle (71, 111) and the bottom lens segments (81, 121) of the primary (50) and the secondary lens (90), results in a light distribution (150) of uniform brightness without any bright or dark spots. The boundaries (155) of the illuminated area (150) are fuzzy on the sides and towards the bottom, whereas the top edge (153) is perfectly defined by a horizontal line. In this example this top edge (153) lies directly below the horizon line (156) (see FIG. 6), which lies, for example, in the horizontal middle longitudinal plane (22). In the embodiment example the height of the image (150) corresponds at least in the intersecting plane of the vertical middle longitudinal plane (21) to 130% of the height of the basic distribution, which is produced by means of the middle lens segments (71, 111).

If now in addition the light bundle (141), produced by the upper lens segments (61, 101) is overlapped, the result is the illuminated area (150), depicted in FIG. 6. The individual lines (159) connect points of identical light intensity on the measurement wall (2). The horizontal cut-off (153), which passes over into a 15-degree rise (154), lies on the horizon line (156) above the hot spot (151). On this edge (153, 154) the light intensity of the illuminated field (150)—in the direction of the area above the horizon line (156)—decreases very significantly. To the left and towards the bottom the light intensity decreases continuously over an angle of, for example, 8 degrees; to the right the light intensity decreases, for example, in an angular range of 10 degrees.

Therefore, operating the low beam headlight in a motor vehicle produces a light intensity distribution analogous, for example, to the conventional halogen headlights. The blinding of the traffic in the opposite direction is prevented by the arrangement of the cut-off (153) below the horizon plane (156). At the same time the 15 degree rise makes it possible to illuminate, for example, the right edge of the road.

When such a low beam headlight is used for the left hand traffic, the headlight may be constructed in such a manner that the bottom edges (66, 67) of the top lens segments (61) decrease from the top left to the bottom right.

FIG. 7 depicts a low beam headlight (210) with a single light module (220), the top lens segment (261) of which lies parallel to the horizontal middle longitudinal plane (22) of the light module (220). Even the lens segment (271), adjacent thereto, is pointed parallel to this plane (22). The longitudinal section of this light module (220) in vertical middle longitudinal plane (22) is, for example, identical to the drawing in FIG. 2.

When the low beam headlight (210) is in operation, the result is, for example, the light distribution (350), depicted in FIG. 8, on a measurement wall (2). In this example the hot spot (351) lies 1.5 degrees below the horizon plane (356). The illuminated field (350) on the measurement wall (2) is approximately symmetrical to the vertical middle longitudinal plane (21). The horizontal cut-off (353) is clearly formed and forms the top edge (353) of the illuminated field (350). The lines of identical light intensity (359) are spaced largely equidistant from each other towards the side and towards the bottom. Therefore, the light intensity decreases uniformly towards the edges without any fringes and without any discontinuity.

FIG. 9 depicts a low beam headlight (410) with, for example, eight light modules (420, 620). The individual light modules (420, 620) are distributed, for example, in the vehicle chassis in such a manner that each vertical middle longitudinal plane (21) of two adjacent light modules (420, 620) encloses an angle of 4 degrees. In this example the light modules (420, 620) sit in a common housing (not illustrated). The individual light modules (420, 620) are not separated from each other by partitions. In this embodiment example the low beam headlight (410) has a width of 140 millimeters.

In this example the light modules (420, 620) each comprise a primary lens (450, 650) and a secondary lens (490), each of which consists of three lens segments (461, 471, 481; 501, 511, 521; 661, 671, 681) that are arranged one above the other. In this respect the middle lens segment (511) and the bottom lens segment (521) of the secondary lens (490) is a part of all of the light modules (420, 620). The light emergence surfaces (514, 524) of these lens segments (511, 521) have the shape of gates. The light bundles, which traverse the middle lens segments (471, 671) of the primary lenses (450), impinge on the middle lens segment (511), which is assigned to these lens segments (471, 671) and which belongs to the secondary lens (490). In so doing, the individual light bundles of the light modules (420, 620), which are arranged side by side, can penetrate each other. The light bundles, issuing from the bottom lens segments (481, 681), impinge on the mirror (530). The mirror (530) has the shape of a part of a shell surface of a section of a cone. In this embodiment example the imaginary section of a cone has a circle as the base surface and as the cover surface. The imaginary axis of the cone lies outside the low beam headlight (410).

For example, in the four middle light modules (420) the lens segments (461, 471, 481) of the primary lenses (450) are constructed at least approximately in the same way as the lens segments (61, 71, 81) of the low beam headlight (10), depicted in FIG. 1. In the other light modules (620), which are arranged here on the edge of the low beam headlight (410), the shape of the primary lens (650) matches at least to a large extent the shape of the primary lens (250), depicted in FIG. 7. In the secondary lenses (490) the top lens segments (501) for each light module (420, 620) are constructed separately. All of these lens segments (501) are pointed towards one area—the hot spot (551).

When the low beam headlight (410) is in operation, the result is, for example, the light distribution (550), depicted in FIG. 10, on a measurement wall (2), which is set up, for example, at a distance of 25 meters. The middle and the bottom lens segments (471, 511; 481, 521; 671, 511; 681, 521) each produce the basic light distributions, which overlap. The result is an image that is without bands and without spots. In this embodiment example the image has the shape of a wide oval. The width of this oval is, for example, defined by two planes, which intersect in the geometric center of the low beam headlight (410) and enclose with each other an angle of, for example, 50 degrees. The height of the oval is limited by the horizontal middle longitudinal plane (22) of all modules (420, 520) and another plane, intersecting the measurement wall (2) below the horizontal middle longitudinal plane (22). The planes intersect, for example, in the geometric center of the low beam headlight (410) and enclose with each other an angle of 10 degrees. The top edge (553) of the illuminated area (550) is an approximately horizontal, high contrast limit. The light intensity of the illumination decreases continuously in the direction of the other edges. Owing to the light modules (420, 620), which are arranged side by side, there are no distortions, variations in color or shadings in at least the width of the illumination.

The basic light distribution is superimposed by the light that is guided through the top lens segments (461, 501; 661, 501). In so doing, a hot spot (551) with a high intensity is produced. Above the cut-off (553) an illuminated, at least approximately rectangular triangle is produced above the horizon plane (556), for example on the right. An imaginary cathetus lies on the extension of the cut-off line (553). The hypotenuse (561) encloses with this cathetus an angle of 15 degrees and rises towards the right. This triangle is illuminated by means of the lens segments (461, 501) of the middle light modules (450). The brightness of the illumination is less than the illumination of the hot spot (551), on which light from all of the light modules (420, 620) impinges.

If the intensity of the hot spot (151, 351, 551) is to be increased, the distance between the primary lens (50, 250, 450) and the secondary lens (90, 290, 490) may be increased. Then at least the top lens segment (61, 261, 461, 661) of the primary lens (50, 250, 450, 650) must be aligned in such a way that only the light entry surface (103) of the secondary lens (90, 290, 490) is illuminated. To this end, for example, the curvature of the light emergence surface (61, 264, 464, 664) may be increased.

In order to displace the hot spot (151, 351, 551) or rather all of the light distribution (150, 350, 550) towards the bottom or towards the top, the secondary lens (90, 290, 490) or the individual lens segments (101, 111, 121; 301, 311, 321; 501, 511, 521) of this lens (90, 290, 490) may be displaced towards the bottom or towards the top. Even the use of other lens sections for the lens segments (101, 111, 121; 301, 311, 321; 501, 511, 521) is conceivable. In this example the primary lens (50, 250, 450) is constructed in such a way that the individual partial light bundles. (141-143) strike the related lens segment (101, 111, 121; 301, 311, 321, 501, 511, 521) of the secondary lens (90, 290, 490).

The hot spot (151, 351, 551) may also be produced by means of the light bundle (143), which is reflected on the mirror (130, 530).

The intensity distribution inside the light bundles (141; 142; 143) changes, for example, by means of the primary lens (50, 250, 450). In so doing, for example, the individual lens segments (61, 71, 81; 261, 271, 281; 461, 471, 481; 661, 671, 681) are shifted towards the bottom or towards the top. Other lens sections may also be selected; or, for example, the curvature of the top lens segment (61, 261, 461, 661) in the horizontal and/or in the vertical direction may be increased; or the tilt of the lens segment (61, 261, 461, 661) may be changed.

The low beam headlight (10, 210, 410) or the individual light module (20, 220, 420, 620) may comprise a disk, which is, for example, clear and which is connected optically downstream of the secondary lens (90, 290, 490).

Instead of the condenser lens (40), at least one light guiding body may also be used. Said light guiding body guides the light, emitted by the light source (30), to the light entry surfaces (63, 73, 83) of the primary lens (50). Owing to the large surface outcoupling, the position of the light-emitting chip (33) is not critical.

If, for example, the low beam headlight (410) is to be used for left hand traffic, the middle light modules (420) may be supplemented, for example, with adjacent light modules, where the top lens segment (461) is tilted in the other direction. Then, for example, the top lens segments (461) of these light modules (20) may be opened or closed by means of a shutter. Then the basic distribution may be produced with all of the light modules (20).

LIST OF REFERENCE NUMERALS

| | |
|---|---|
| 1 | environment, air |
| 2 | measurement wall |
| 10, 210, 410 | low beam headlight |
| 20, 220, 420, 620 | light modules |
| 21 | vertical middle longitudinal plane |
| 22 | horizontal middle longitudinal plane |
| 23 | tangential plane at (114, 314, 514) |
| 24 | tangential plane at (124, 324, 524) |
| 25 | optical axis |
| 26 | light propagation direction |
| 27 | reference length |
| 30 | light source, light diode |
| 33 | light emitting chip |
| 34 | light distributing body, shaped radiating, body |
| 40 | condenser lens |
| 42 | concavely curved lens surface |
| 43 | boundary line |
| 45 | collector lens |
| 47 | annular flange |
| 50, 250, 460, 650 | primary lenses |
| 51 | attachment flange |
| 59 | envelope contour of (64) in (21) |
| 61, 261, 461, 661 | top lens segments |
| 62 | top side |
| 63 | light entry surface of (61) |
| 64, 264, 464, 664 | light emergence surfaces of (61, 261, 461, 661) |
| 65 | middle transverse surface |
| 66 | bottom edge of (63) |
| 67 | bottom edge of (64) |
| 68 | center of curvature of (63) |
| 69 | center of curvature of (64) |
| 71, 271, 471, 671 | middle lens segments |
| 72 | top side |
| 73 | light entry surface of (71) |
| 74, 274, 474, 674 | light emergence surfaces of (74, 274, 474, 674) |
| 75 | middle transverse surface |
| 76 | bottom edge of (73) |
| 77 | bottom edge of (74) |
| 78 | center of curvature of (73) |
| 79 | center of curvature of (74) |
| 81, 281, 481, 681 | bottom lens segments |
| 82 | top side |
| 83 | light entry surface, plane surface |
| 84, 284, 484, 684 | light emergence surfaces of (81, 281, 481, 681) |
| 85 | middle transverse surface |
| 86 | bottom edge of (84) |
| 87 | top edge of (83) |
| 88 | top edge of (84) |
| 89 | center of curvature of (84) |
| 90, 290, 490 | secondary lenses |
| 91 | attachment flange |
| 101, 301, 501 | top lens segments |
| 103 | light entry surface |
| 104, 304, 504 | light emergence surface of (101, 301, 501) |
| 109 | center of curvature |
| 111, 311, 511 | middle lens segments |
| 113 | light entry surface |

-continued

| | |
|---|---|
| 114, 314, 514 | light emergence surfaces of (111, 311, 511) |
| 118 | contour |
| 119 | center of curvature |
| 121, 321, 521 | bottom lens segments |
| 123 | light entry surface |
| 124, 324, 524 | light emergence surfaces of (121, 321, 521) |
| 126 | bottom edge of (123) |
| 128 | contour of (124) |
| 129 | center point of (128) |
| 130, 530 | mirror |
| 131 | reflecting area |
| 140 | light |
| 141-143 | partial light bundle |
| 150, 350, 550 | illuminated areas, light distribution |
| 151, 351, 551 | hot spots, target area |
| 152 | intensity maximum of (151) |
| 153, 353, 553 | top edge, cut-off line |
| 154, 554 | 15 degree rise |
| 155 | boundaries |
| 156, 356, 556 | horizon plane |
| 159, 359, 559 | lines |
| 162, 166 | parallel rays of (165) |
| 163, 167 | nodal point rays of (165) |
| 164, 168 | focal point rays of (165) |
| 165 | object |
| 172, 176 | parallel rays of (175) |
| 173, 177 | nodal point rays of (175) |
| 174, 178 | focal point rays of (175) |
| 175 | object |
| 180 | object |
| 181 | virtual image of (81) |
| 182 | parallel ray of (185) |
| 183 | nodal point ray of (185) |
| 184 | focal point ray of (185) |
| 185 | virtual object |
| 186 | parallel ray of (185) |
| 187 | nodal point ray of (185) |
| 188 | focal point ray of (185) |
| 189 | virtual image of (87) |
| 561 | hypotenuse |

The invention claimed is:

1. Low beam headlight with at least one light module, wherein the individual light module exhibits at least one light source and at least one primary lens connected downstream of the light source; and wherein the light source is a luminescent diode, characterized in that the low beam headlight (10; 210; 410) has at least one secondary lens (90; 290; 490), which is connected optically downstream of the primary lens (50; 250; 450, 650) or the primary lenses (50; 250; 450, 650), that both the primary (50; 250; 450, 650) and the secondary lens (90; 290; 490) exhibit at least two lens segments (61, 71, 81; 101, 111, 121; 261, 271, 281; 301, 311, 321; 461, 471, 481; 501, 511, 521; 661, 671, 681), which are arranged one over the other, that at least one lens segment (61, 71, 81; 261, 271, 281; 461, 471, 481; 661, 671, 681) of a primary lens (50, 250, 450, 650) is assigned to a lens segment (101, 111, 121; 301, 311, 321; 501, 511, 521) of a secondary lens (90, 290, 490), that at least one lens segment (61, 261, 461, 661) of the primary lens (50, 250, 450, 650) and its assigned lens segment (101, 301, 501) of the secondary lens (90, 290, 490) lie outside optical axis (25) of the light module (20; 220; 420; 620), that at least light emergence surface (64, 264, 464, 664) of this lens segment (61, 261, 461, 661) of the primary lens (50, 250, 450, 650) exhibits at least one envelope surface that is biaxially curved, and that a sum of radii of curvature of at least one surface element of the envelope surface of this light emergence surface (64, 264, 464, 664) in two planes that are normal to each other is less than the sum of the radii of curvature of at least one surface element of the envelope surface of at least one other light emergence surface (74, 84; 274, 284; 474, 484; 674, 684) of the primary lens (50, 250, 450, 650) in two planes that are normal to each other.

2. Low beam headlight, as claimed in claim 1, characterized in that the sum of the radii of curvature of each surface element of the envelope surface of this light emergence surface (64, 264, 464, 664) in two planes that are normal to each other is less than the sum of the radii of curvature of each surface element of the envelope surface of at least one other light emergence surface (74, 84; 274, 284; 474, 484; 674, 684) of the primary lens (50, 250, 450, 650) in two planes that are normal to each other.

3. Low beam headlight, as claimed in claim 1, characterized in that the envelope surface of the lens segment (64, 264, 464, 664) has the shape of a surface that is curved so as to be triaxially convex.

4. Low beam headlight, as claimed in claim 1, characterized in that the envelope curve of the lens segment (64, 264, 464, 664) in a plane parallel to the horizontal middle longitudinal plane (22) of the light module (20, 220, 420, 620) exhibits a curvature that is less than the smallest curvature of the envelope curve (59), which lies in the vertical middle longitudinal plane (21).

5. Low beam headlight, as claimed in claim 1, characterized in that a condenser lens (40) is arranged between the light source (30) and the primary lens (50, 250, 450, 650).

6. Low beam headlight, as claimed in claim 1, characterized in that the distance of the lens segment (61, 261, 461, 661) from the optical axis (25) is greater than 5% of the distance between the light emitting chip (33) of the light source (30) and the light emergence surface (124, 324, 524), which belongs to the secondary lens (90, 290, 490) and which is furthest away in the light propagation direction (26).

7. Low beam headlight, as claimed in claim 1, characterized in that the envelope surface of the light emergence surface (74, 274, 474, 674) of the lens segment (71, 271, 471, 671) is a section of a cylinder or torus shell surface, whose centers of curvature (79) lie in a plane parallel to the horizontal middle longitudinal plane (22) of the light module (20, 220, 420, 620).

8. Low beam headlight, as claimed in claim 1, characterized in that the lens segment (61, 461) is wedge-shaped.

9. Low beam headlight, as claimed in claim 8, characterized in that the bottom edge (66) of the lens segment (61, 461) encloses with the horizontal middle longitudinal plane (22) an angle that ranges from 5 degrees to 25 degrees.

10. Low beam headlight, as claimed in claim 1, characterized in that it exhibits a mirror (130; 530), whose reflecting surface (131) in a top view of a light module (20, 220, 420, 620) lies between the primary lens (50; 250; 450; 650) and the secondary lens (90; 290; 490).

11. Low beam headlight, as claimed in claim 10, characterized in that the mirror (130) is a flat mirror.

12. Low beam headlight, as claimed in claim 1, characterized in that it comprises at least two light modules (420, 620), the secondary lenses (490) of which have at least one common lens segment (511, 521).

13. Low beam headlight, as claimed in claim 12, characterized in that the off-centered lens segments (461, 661) of the light modules (420, 620) are aimed at the same target area (551).

14. Low beam headlight, as claimed in claim 1, characterized in that the width of each lens segment (61, 71, 81, 101, 111, 121; 261, 271, 281, 301, 311, 321; 461, 471, 481, 501, 511, 521, 661, 671, 681) normal to the vertical middle longitudinal plane (21) is greater than its height in the vertical middle longitudinal plane (21).

15. Low beam headlight, as claimed in claim 1, characterized in that when operating the light source (30), the light emergence surfaces (64, 74, 84; 264, 274, 284; 464, 474, 484; 664, 674, 684) of the primary lens (50, 350, 450, 650) are not totally illuminated.

16. Low beam headlight, as claimed in claim 1, characterized in that precisely one lens segment (101; 301; 501) of the secondary lens (90, 290, 490) is assigned to the lens segment (61; 261; 461; 661) of the primary lens (50, 350, 450, 650).

* * * * *